United States Patent [19]

Menelly

[11] 4,285,030

[45] Aug. 18, 1981

[54] FLASHLIGHT ASSEMBLY

[76] Inventor: Richard A. Menelly, 10798 4th Ave., Hesperia, Calif. 92345

[21] Appl. No.: 97,137

[22] Filed: Nov. 26, 1979

[51] Int. Cl.[3] ..... F21L 7/00

[52] U.S. Cl. ..... 362/200 Q; 362/208; 362/253

[58] Field of Search ..... 362/200, 208, 253

[56] References Cited

U.S. PATENT DOCUMENTS

| | | | |
|---|---|---|---|
| 3,899,670 | 8/1975 | Delfortrie | 362/201 |
| 4,069,404 | 1/1978 | Minoprio | 362/200 |

*Primary Examiner*—Stephen J. Lechert, Jr.

*Attorney, Agent, or Firm*—Richard A. Menelly; Francis X. Doyle

[57] ABSTRACT

A portable flashlight assembly utilizes a flat battery energy source containing slide contact electrodes. One embodiment includes the use of a film pack from a self-developing camera as an energy source.

6 Claims, 4 Drawing Figures

FLASHLIGHT ASSEMBLY

BACKGROUND OF THE INVENTION

Selfdeveloping cameras are available which use a combination film pack and power source in a unitary module for providing film to the camera and electricity for energizing the film transport mechanism and for activating flash lamps.

Quite often, as when most of the film within the pack is used for daylight photographs, a substantial amount of energy remains within the battery portion of the film pack when the pack becomes discarded. Besides presenting an obvious waste of energy it is conceivable that the electrical energy remaining within the discarded film pack could present a hazard.

There are no methods available, at the present time, for recycling the film pack back to the supplier for re-energizing the battery portion of the pack and replenishing the pack with a fresh set of photographic film.

The purpose of this invention is to disclose a portable light source which is adapted to receive a film pack and utilize the remaining electrical energy in the battery portion to energize a light bulb.

SUMMARY OF THE INVENTION

The invention comprises a portable flashlight assembly having a receptacle for slidingly receiving and retaining a film pack. The battery portion of the film pack slidingly engages a pair of electrical contacts within the housing of the flashlight for delivering electrical energy to a flashlight bulb.

One embodiment provides the electrical connection between the battery portion of the power pack and the bulb portion of the flashlight without the need for any mechanical or electrical switch.

and

Figure 1:
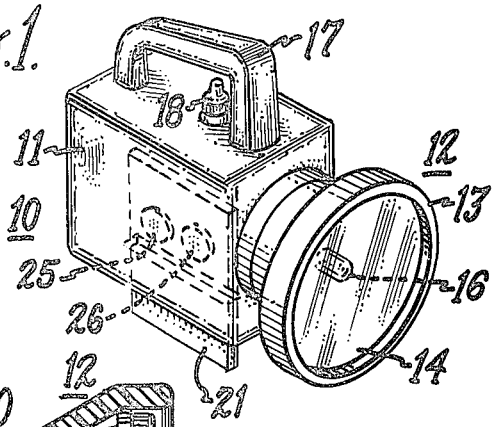
FIG. 1 is a top perspective view of the flashlight of the invention.
Figure 2:
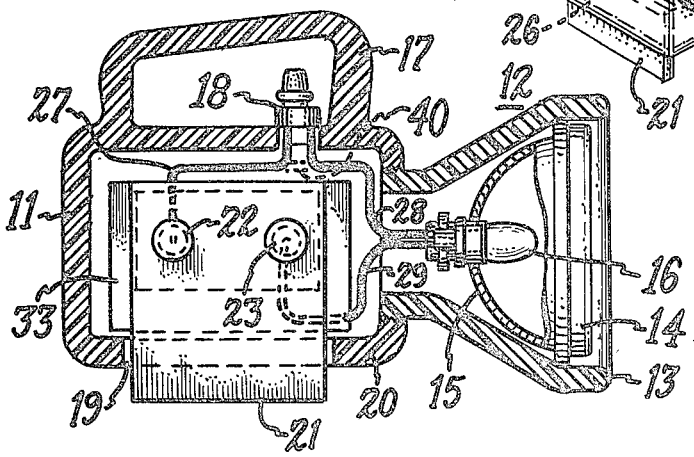
FIG. 2 is a side sectional view of the flashlight of FIG. 1.
Figure 4:
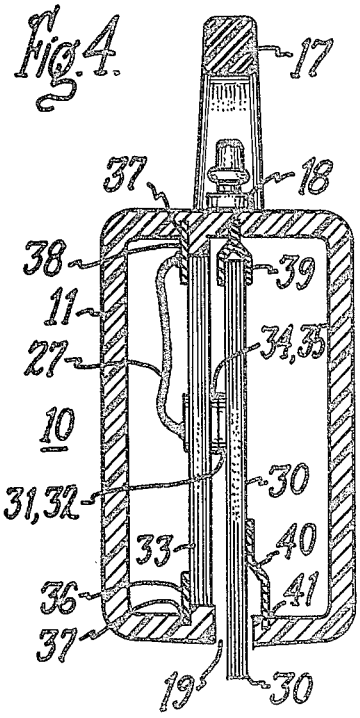
Figure 3:
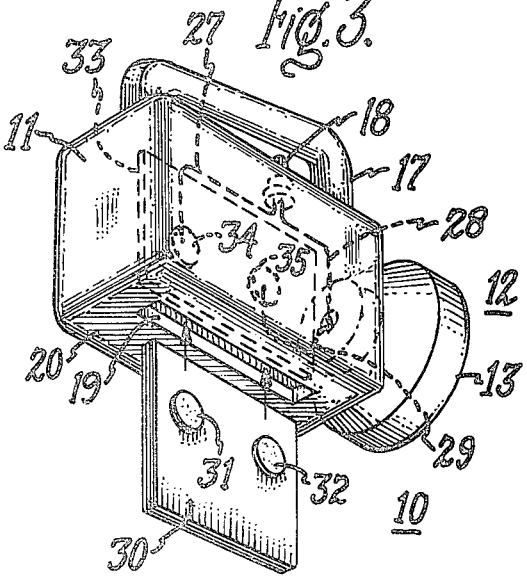
FIG. 3 is a bottom perspective view in partial section of the flashlight depicted in FIGS. 1 and 2.

FIG. 4 is an end sectional view of the flashlight of the invention depicted in FIGS. 1–3.

DESCRIPTION OF THE PREFERRED EMBODIMENT

The flashlight 10 of the invention is shown in FIGS. 1 and 2 to comprise a housing 11 having a lamp portion 12 which consists of a cover 13, lens 14, reflector 15, and bulb 16. Housing 11 further includes a handle 17 and an on-off switch 18 which operate in a manner similar to most hand-held flashlamps. Also included on housing 11 is a slot 19 situated on the bottom 20 of housing 11. Slot 19 readily provides for the insertion of film pack 21 containing electrodes 22 and 23. The film pack 21 is of the type commonly employed in self-developing cameras which include a plurality of film negatives and a separate battery portion designated by the dotted lines 24. When film pack 21 is inserted within slot 19, electrodes 22, 23 contact electrodes 25 and 26 within housing 11. Electrodes 25 and 26 in turn electrically connect through switch 18, leads 27, 28, and 29 with bulb 16.

FIG. 3 contains a flashlight 10 having a housing 11, handle 17, and lamp portion 12 similar to that described for the embodiments of FIGS. 1 and 2. Bottom portion 20 contains slot 19 for receiving a flat battery pack 30 containing electrodes 31 and 32. Battery pack 30 is made specifically for energizing flashlight 10 and does not contain any film such as that described for film pack 21 in the embodiments of FIGS. 1 and 2. Housing 11 also contains a printed circuit board 33 affixed to the interior surface of housing 11 and containing electrodes 34 and 35 for slidingly contacting and engaging electrodes 31 and 32 of battery pack 30. A switch 18 and leads 27, 28, and 29 are also employed in a manner similar to that described for the earlier embodiments.

FIG. 4 shows one arrangement for mounting printed circuit board 33 within housing 11. Printed circuit board 33 is riveted at one end to a bracket 36 which is formed or pressed-fitted within slot or recess 37 in housing 11.

Top portion of circuit board 33 is held by a second bracket 38 which is secured at one end within a slot or recess 37 within housing 11 which is made from a molded plastic for ease and economy but other materials such as metals and hard rubber compounds can also be employed. Battery pack 30 is slidingly inserted within casing 30 is a manner similar to that described for film pack 21 and is retained by clip 39 within the casing. Guide 40 attached to housing 10 at slot or recess 41 insures that power pack 30 is centered within housing 11 and that electrodes 31, 32 on power pack 30 are forced into good electrical and mechanical contact with electrodes 34, 35 on circuit board 33.

In some instances switch 18 can be dispensed with and mere insertion of power pack 30 within housing 11 completes the circuit by means of a shunt 40 shown in dotted lines in FIG. 2.

Although the flashlight of the invention is described as a hand-held portable device, this is by way of example only. The flashlight of the invention can be employed in any type application whatsoever including vehicle mounted, emergency, as well as military applications.

I claim:

1. A flashlight comprising:

a lamp assembly including means for mounting a bulb, reflector, and lens;

a housing having a slotted portion for receiving a rectangular battery source;

electrode means within said housing for contacting a pair of electrodes on said battery;

a first electrical connector between one of said housing electrodes and said lamp mounting means and a second conductor connecting between the other of said electrodes on said housing and said lamp mounting means;

a switch electrically connected in series with one of said first and second electrical connectors;

said slotted portion extending through the interior of said housing from a bottom portion of said housing to a top portion;

a guide member extending from an interior portion of said housing for centering said battery within said housing; and a retaining member attached to an interior portion of said housing for slidingly engaging said battery.

2. The flashlight of claim 1 wherein said electrodes within said housing are supported by a circuit board.

3. The flashlight of claim 2 wherein the circuit board is fixedly attached to at least one side of said housing.

4. The flashlight of claim 3 wherein the circuit board is coextensive with said interior slot within said housing.

5. The flashlight of claim 1 wherein said battery comprises a film pack from a selfdeveloping camera.

6. The flashlight of claim 5 wherein said housing is selected from the group consisting of plastic, metal, and rubber.

* * * * *